US010356516B2

(12) United States Patent
Larsen et al.

(10) Patent No.: US 10,356,516 B2
(45) Date of Patent: Jul. 16, 2019

(54) BONE CONDUCTION MICROPHONE

(71) Applicant: Nextlink IPR AB, Malmö (SE)

(72) Inventors: Jan Larsen, Smørum (DK); Dennis Normann Andersen, Ølstykke (DK)

(73) Assignee: Nextlink IPR AB, Malmö (SE)

( * ) Notice: Subject to any disclaimer, the term of this patent is extended or adjusted under 35 U.S.C. 154(b) by 0 days.

(21) Appl. No.: 15/574,327

(22) PCT Filed: May 18, 2016

(86) PCT No.: PCT/EP2016/061157
§ 371 (c)(1),
(2) Date: Nov. 15, 2017

(87) PCT Pub. No.: WO2016/184923
PCT Pub. Date: Nov. 24, 2016

(65) Prior Publication Data

US 2018/0146283 A1 May 24, 2018

(30) Foreign Application Priority Data

May 18, 2015 (DK) ..... 2015 70286

(51) Int. Cl.
*H04R 1/46* (2006.01)
*H04R 1/08* (2006.01)
*H04R 1/10* (2006.01)

(52) U.S. Cl.
CPC ..... *H04R 1/46* (2013.01); *H04R 1/083* (2013.01); *H04R 1/1016* (2013.01)

(58) Field of Classification Search
CPC ..... H04R 2460/13; H04R 1/1016
(Continued)

(56) References Cited

U.S. PATENT DOCUMENTS 4,628,907 A * 12/1986 Epley ..... H04R 25/606 381/322
5,455,842 A * 10/1995 Mersky ..... B63C 11/26 128/200.29

(Continued)

FOREIGN PATENT DOCUMENTS

JP 2014-166241 9/2014
WO WO 2014/022359 A2 2/2014

OTHER PUBLICATIONS

International Search Report issued in corresponding International Patent Application No. PCT/EP2016/061157, dated Aug. 3, 2016 (3 pages).

(Continued)

*Primary Examiner* — Suhan Ni
(74) *Attorney, Agent, or Firm* — Nixon Peabody LLP

(57) ABSTRACT

A bone conduction microphone device that registers speech signals from a user. The microphone device includes a housing having an abutment or contact part, which has a central axis substantially parallel to a predetermined distal direction and a predetermined proximal direction. The abutment, during use, abuts against and is in vibratory contact with tissue of a head or neck of the user, and receives, during use, vibrations, representing a speech signal and propagating through at least a part of the user's tissue or bone structures in the head or neck when the user is speaking. The housing further includes or is connected to at least one sealing element, which substantially or at least partly encircles the abutment or contact part about the central axis.

31 Claims, 4 Drawing Sheets

(58) Field of Classification Search
USPC ..... 381/151, 326, 380
See application file for complete search history.

(56) References Cited

U.S. PATENT DOCUMENTS

| | | | | |
|---|---|---|---|---|
| 9,118,404 | B2 * | 8/2015 | Imran | H04B 11/00 |
| 2004/0249633 | A1 | 12/2004 | Asseily | |
| 2010/0290660 | A1 | 11/2010 | Fukuda | |
| 2011/0135120 | A1 | 6/2011 | Larsen | |
| 2014/0126737 | A1 | 5/2014 | Burnett | |
| 2014/0270230 | A1 * | 9/2014 | Oishi | H04R 1/1016 381/74 |

OTHER PUBLICATIONS

Written Opinion issued in corresponding International Patent Application No. PCT/EP2016/061157, dated Aug. 3, 2016 (5 pages).

* cited by examiner

BONE CONDUCTION MICROPHONE

CROSS-REFERENCE TO RELATED APPLICATIONS

This application is a U.S. National Stage of International Application No. PCT/EP2016/061157, filed May 18, 2016, which claims the benefit of Denmark Patent Application No. PA201570286, filed May 18, 2015, both of which are incorporated herein by reference in their entireties.

FIELD OF THE INVENTION

The present invention relates to a bone conduction microphone device adapted to register speech signals from a user, the bone conduction microphone device comprising a housing comprising an abutment or contact part being adapted to, during use, abut against and be in vibratory contact with tissue of at least a part of a head of the user, and being further adapted to receive, during use, vibrations representing a speech signal and propagating through at least a part of the user's tissue and/or bone structures in the head of the user when the user is speaking.

BACKGROUND

In-ear, behind-the-ear, over-the-ear/ear loop/on-the-ear, over-the-head, backwear/behind-the-neck headsets or the like, throat- and head microphones, earphones, and other voice communication devices are generally well-known in the art and used to facilitate one- or two-way communication between a user and another distant user or device. The voice communication devices or the like may be coupled to a mobile terminal that transmits and receives audio signals to and from the voice communication devices or the like via a wired or wireless communication channel.

During normal operation, a housing portion of the headset or voice communication device, etc. is fitted appropriately on the user's head, e.g. in the ear (canal), behind the ear, onto the ear or onto the nose, head, chin, etc. This housing portion often comprises a loudspeaker or similar, when worn in connection with the ear, coupled to a sound outlet of the housing portion so that audio signals received from the distant user or device are processed and transmitted to the user's ear canal, or more specifically to an ear canal volume residing in front of a tympanic membrane or eardrum.

For transmission of the user's own voice, an important type of headsets, voice communication device, etc. are adapted to pick up the user's voice by sound transmission via vibration through the user's tissue and/or bone structures. The voice pick-up may be enabled by a bone conduction microphone in vibratory contact with tissue of the user's head. A distinctive advantage of this type of sound pick up is good suppression of environmental noise in the microphone signal to be transmitted to the distant user or device allowing the user's speech to be conveyed with high fidelity and intelligibility even when the user is located in a very noisy acoustical environment. A further advantage is also the avoidance of a boom microphone or similar that needs to be located precisely in front of the mouth, is susceptible to picking up noise in addition to the user's speech, is uncomfortable and/or in the way of other equipment such as helmets, gasmasks etc.

Such bone conduction microphones are also referred to as bone conduction transducers, vibration pick-ups or transducers, etc.

FIG. 2 illustrates one example of a traditional bone conduction microphone (BCM) 101 that generally comprises housing 102 with an abutment or contact part 103.

The abutment or contact part 103 (forth only referred to as abutment part) is for abutment against and in contact with tissue of the head of the user, e.g. tissue in the ear canal of a user, and this part 103 is, during use, normally pressed or secured against at least a part of the head of the user and registers the vibrations propagating through the user's tissue and/or bone structures where the vibrations primarily are caused by the user speaking. A part, different from the abutment part, of the housing is generally for connecting/interfacing with the rest of a voice communication device or circuit (see e.g. 100 in FIG. 1) and is typically embedded in or connected to the device.

During use, a traditional BCM will be placed firmly against the ear or another suitable part of the user's head enabling good sound/vibration pickup properties.

However, such traditional BCMs, even when firmly in place, may still register unwanted vibrations and/or noise from the environment.

Even if the BCM is embedded in the tissue of the user to a certain degree, the BCM may still register vibrations or sound from the surrounding environment via air being in contact with the sides of the BCM.

In particular if the BCM is located on a more exposed location of the user's head e.g. like the nose, the neck, on the top of the head, the chin, behind the ear, in the ear (but outside the ear canal) etc.

As indicated in FIG. 2, a distal direction and an opposite proximal direction are defined in reference to the BCM, as shown by the two opposite arrows, where the sides of the BCM are located rotationally about the distal and proximal directions.

The distal end is labelled so since this is the end normally further/furthest away from the voice communication device that the BCM is mounted or attached to while the proximal end is labelled so since this is the end normally closest to the voice communication device.

A BCM is usually designed to register sound through vibrations from the distal relatively flat or curved abutment end or part. However, the sides of the BCM can potentially cause registration of unwanted vibrations and/or noise, which may degrade or mask the sound quality of the speech picked up from the user.

Patent specification U.S. Pat. No. 8,705,787 discloses a custom in-ear headset comprising a bone conduction microphone where the headset comprises a number of substantially hard ridges circumscribing a housing portion of the headset. The one or more ridges acoustically seals off a user's ear canal when the headset in inserted into the ear of a user and the ridge(s) thereby is/are pressed against a relatively soft cartilaginous portion of the user's ear canal.

Patent application WO 2014/022359 discloses earphone systems and methods for automatically directing ambient sound to an earphone device where an earphone device is to be inserted into the ear canal of a user. The earphone device comprises a sealing section that occludes the ear canal and an ear canal microphone that is acoustically coupled to the occluded ear canal via an acoustic tube.

Thus it would be a benefit to have a BCM or similar that does not register unwanted vibrations and/or noise or at least register unwanted vibrations and/or noise to a lesser extent.

SUMMARY

It is an object to alleviate one or more of the above mentioned drawbacks at least to an extent.

Furthermore, it is an object to provide a BCM that does not register unwanted vibrations and/or noise or at least register unwanted vibrations and/or noise to a lesser extent.

The invention is defined in claim 1.

Accordingly, in one aspect of the present invention, a bone conduction microphone device (also referred to simply as BCM) is provided being adapted to register speech signals from a user, the bone conduction microphone device comprising a housing comprising an abutment or contact part, the abutment or contact part having a central axis being substantially parallel to a predetermined distal direction and a predetermined proximal direction (the distal and proximal directions being opposite and parallel), being adapted to, during use, abut against and be in vibratory contact with tissue of at least a part of a head or neck of the user, and being further adapted to receive, during use, vibrations, representing a speech signal and propagating through at least a part of the user's tissue and/or bone structures in the head or neck of the user when the user is speaking, wherein the housing further comprises or is connected to at least one sealing element (the at least one sealing element being comprised by the bone conduction microphone device), the at least one sealing element substantially or at least partly encircling the abutment or contact part about the central axis.

In this way, a BCM is provided that does not register unwanted vibrations and/or noise or at least register unwanted vibrations and/or noise to a lesser extent. More particularly, the BCM is efficiently shielded from directions/sides except from the distal direction (where it is designed to pick up vibrations). A BCM does not need (or at least significantly less so) to be shielded from the proximal direction as this is where the voice communication device is located.

This will be advantageous for BCM locations e.g. inside the ear canal of a user and even more so for BCM locations that are more exposed, e.g. behind the ear, on the nose, head, chin, and so on.

In some embodiments, at least one of the at least one sealing element fully encircles the abutment or contact part about the central axis.

This has the advantage that the BCM is shielded even more effectively.

In some embodiments, at least one of the at least one sealing element extends outwardly and away from the housing (of the BCM). This facilitates a reliable sealing when abutting against skin of the user or a housing of a voice communication device comprising the BCM, especially if the at least one of the at least one sealing element is made of a flexible and/or resilient material.

In some embodiments, the at least one of the at least one sealing element extends outwardly and away from the housing (of the BCM) in the distal direction. In alternative embodiments, the at least one of the at least one sealing element extends outwardly and away from the housing (of the BCM) in the proximal direction.

In some embodiments, the at least one sealing element is adapted to encircle at least a distal end of the abutment or contact part.

In some embodiments, the at least one sealing element is adapted to encircle at least a most distal end of the abutment or contact part.

In some embodiments, the abutment or contact part is adapted to abut against and be in vibratory contact, during use, with tissue of at least a part of an inner ear canal of the user, of at least an outer part (i.e. outside the ear canal) of an ear of the user, located behind the ear of the user, of a neck of the user, of a cheek of the user, of a top of the head of the user, of a nose of the user, or on a throat of the user.

In some embodiments, the at least one sealing element is adapted to form an air-tight seal when the abutment or contact part is in place, during use, against the tissue of the user.

This will increase the efficiency of shielding.

In some embodiments, the air-tight seal is formed by the at least one sealing element and the tissue of the user when the abutment or contact part is in place, during use, against the tissue of the user. In alternative embodiments, the air-tight seal is formed by the at least one sealing element and a housing of a voice communication device comprising the bone conduction microphone device when the abutment or contact part is in place, during use, against the tissue of the user. I.e. the tissue presses the at least one sealing element against the housing of the voice communication device thus forming the air-tight seal.

In some embodiments, the housing (of the BCM) defines an exterior radially about the central axis and wherein the air-tight seal is formed in or at least partly in/inside the exterior. 'Partly' signifying that the air-tight seal is formed both in and outside the exterior (outside the exterior being the radial interior as correspondingly defined by the housing of the BCM).

In some embodiments, at least one sealing element defines at least one closed volume of air radially about the central axis (i.e. between the central axis and the sides of the BCM and encircling the central axis). I.e. this closed volume is not formed but rather present all the time regardless of whether the BCM is in place against tissue or not. In some embodiments, the at least one sealing element is closed and hollow and encircles the central axis, i.e. having a shape substantially like a torus or similar about the central axis. In some further embodiments, the at least one sealing element comprises a plurality of tori of different sizes.

This will increase the efficiency of shielding.

In some embodiments, the housing (of the BCM) defines an exterior radially about the central axis and wherein at least one of the at least one closed volume of air is located in or at least partly in the exterior. Partly (again) signifying that the closed volume of air is located both in and outside the exterior (outside the exterior being the radial interior as correspondingly defined by the housing of the BCM).

In some embodiments, at least one of the at least one sealing element is made of a flexible and/or resilient material.

In some embodiments, at least one of the at least one sealing element has a funnel shape extending outwards in the distal direction.

In some embodiments, a distal rim of the funnel (and/or a distal part of one or more sealing elements) is/are substantially level with a most distal part of the abutment or contact part. In alternative embodiments, the distal rim of the funnel is above the most distal part of the abutment or contact part. This may be advantageous especially if the sealing element if flexible and/or resilient.

In other alternative embodiments, the distal rim of the funnel is below the most distal part of the abutment or contact part. This may be advantageous especially if the sealing element is made of a relatively hard(er) material e.g. a hardness sufficient to displace tissue of the user; see e.g the following.

In some embodiments, at least one of the at least one sealing element comprises a first funnel shape extending outwards in the distal direction and a second funnel shape, being connected to the first funnel shape, extending outwards in the proximal direction, or comprises a first funnel shape extending outwards in the proximal direction and a second funnel shape, being connected to the first funnel shape, extending outwards in the distal direction.

In some embodiments, a distal rim of the first and/or second funnel shape is/are substantially level with a most distal part of the abutment or contact part.

In some embodiments, at least one of the at least one sealing element has funnel shape extending outwards in the proximal direction.

In some embodiments, at least one of the at least one sealing element have a hardness sufficient to displace tissue of the user.

In some embodiments, at least one of the at least one sealing element is adapted to displace tissue of the user more than what the abutment or contact part will displace.

In this way, an efficient seal is provided during use, since the (distal) surface of the sealing element, during use, will be pressed further into the tissue of the user than the abutment part.

In some embodiments, at least one of the at least one sealing element has a Shore D hardness larger than 40, or larger than 60, or larger than 80.

In some embodiments, at least one of the at least one sealing element is solid and has a Shore A hardness of 80 or less or a shore D hardness of 60 or less.

Even though the material of one (or more) of the sealing elements are relatively softer is will still displace tissue of the user (due to being solid thereby compressing less) and thus still provide an efficient sealing effect.

In some embodiments, the bone conduction microphone device comprises two or more sealing elements.

In some embodiments, the at least one sealing element is closed and hollow and encircles the central axis, i.e. having a shape substantially like a torus or similar about the central axis. Some further embodiments could comprise a plurality of tori of different sizes.

In some embodiments, at least one of the at least one sealing element is made of or comprises a core of a foam or foam-like material.

Such foam or foam-like material may e.g. be or comprise polyurethane foam, foams based on natural latex, extruded polystyrene foam, polystyrene foam, phenolic foam, and/or many other types of manufactured foams.

In some embodiments, at least one of the at least one sealing element extends outwardly and away from the housing in the proximal direction and wherein the sealing element comprises a proximal part and rim adapted to fit securely into a groove of a housing of a voice communication device when the voice communication device comprises the bone conduction microphone device, and/or be supported by an elevation of a housing of a voice communication device when the voice communication device comprises the bone conduction microphone device, the elevation comprising an abutment surface adapted to support a surface of the proximal part being closest to the housing of the bone conduction microphone device.

According to another aspect of the present invention a voice communication device is provided comprising a bone conduction microphone device according to any one of claims 1-28.

In some embodiments, the voice communication device is any one of a headset unit, an earphone, an in-ear voice communication device, a hearing aid, a throat microphone, a skull microphone, and a voice communication device with at least one microphone but without any speaker.

In some embodiments, the voice communication device comprises a housing comprising a groove adapted to receive and hold a proximal rim of the sealing element of the bone conduction microphone device, and/or an elevation comprising an abutment surface adapted to support a surface of the proximal part of the sealing element of the bone conduction microphone device, the surface being closest to the housing of the bone conduction microphone device.

All headings and sub-headings are used herein for convenience only and should not be constructed as limiting the invention in any way.

The use of any and all examples, and/or exemplary language (like e.g. or such as) provided herein, is intended merely to better illuminate the invention and does not pose a limitation on the scope of the invention unless otherwise claimed. No language in the specification should be construed as indicating any non-claimed element as essential to the practice of the invention.

This invention includes all modifications and equivalents of the subject matter recited in the claims appended hereto as permitted by applicable law.

DETAILED DESCRIPTION

Various aspects and embodiments of bone conduction microphone device (BCM) as disclosed herein will now be described with reference to the figures.

When or if relative expressions such as "upper" and "lower", "right" and "left", "horizontal" and "vertical", "clockwise" and "counter clockwise" or similar are used in the following terms, these only refer to the appended figures and not necessarily to an actual situation of use. The shown figures are schematic representations for which reason the configuration of the different structures as well as their relative dimensions are intended to serve illustrative purposes only.

In that context, it may be convenient to define that the term "distal end" in the appended figures is meant to refer to the end of the BCM which usually register sound through vibration and being furthest/further away from the voice communication device that the BCM is mounted on or attached to whereas the term "proximal end" is meant to refer to the opposite end being closest to the voice communication device that the BCM is mounted or attached to. "Distal direction" is a direction from the proximal end to the distal end while "proximal direction" is a direction from the distal end to the proximal end. Both directions (being parallel and opposite) are e.g. illustrated in FIGS. 2, 4*a* and 5.

Some of the different components are only disclosed in relation to a single embodiment of the invention, but is meant to be included in the other embodiments without further explanation.

Figure 1:
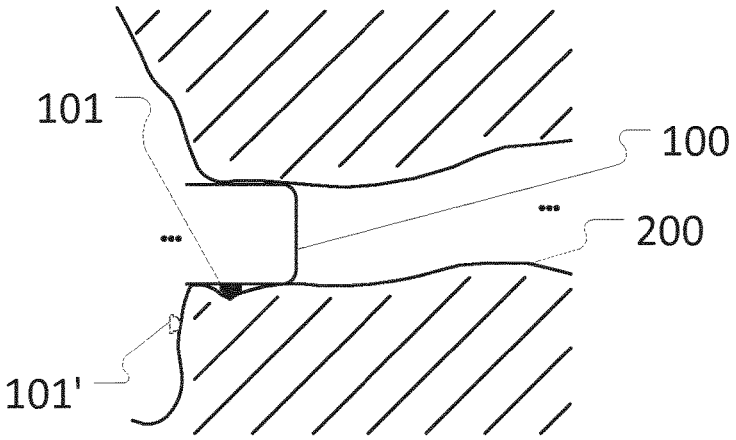
FIG. 1 is a cross-section schematically illustrating a part of an ear and an ear canal of a user and a voice communication device having a BCM in contact with the ear.

FIG. 1 is a cross-section schematically illustrating a part of an ear and a canal of a user and a voice communication device having a BCM in contact with the ear.

Shown, in this particular example, is (a schematic part of) an in-ear voice communication device 100 located at least partially in an ear canal 200 of a user. As mentioned, the device may be a voice communication device not intended for being inserted into the ear.

The voice communication device 100 comprises a BCM 101, preferably one as shown and explained in connection with FIGS. 3, 4*a*-4*b*, and 5 or corresponding embodiments, that protrudes from a housing portion of the voice communication device 100 and abuts against a wall or at least a part of the inner ear canal 200. The BCM registers vibrations caused by the user speaking and propagating through the user's tissue and/or bone structures.

The registered vibrations and thereby registered speech signal is passed on to the communication device 100 for further processing and/or transmission.

During use, the BCM 101 will normally be placed firmly against the ear canal enabling good sound/vibration pickup properties and will normally be 'squeezed' or deformed somewhat if it is made of a relatively soft material.

The BCM will or may in part also displace some of the softer tissue of the ear canal. The BCM may be made e.g. from a silicone rubber or the like and if therefore relatively soft and it may comprise a closed cavity with air or another gas (see e.g. FIG. 4).

However, such traditional BCMs, even when firmly in place, may still register unwanted vibrations and/or noise, e.g. due to having one or more parts of its surface, e.g. at least a part of its sides, exposed to surrounding air if not fully embedded in the tissue.

This may particularly be the case when the BCM is located on a more exposed location of the user's head e.g. like the nose, the neck, on the top of the head, the chin, behind the ear, in the outside ear (outside the ear canal) etc.

FIG. 1 also show one of these alternative locations of a BCM with reference number 101' and being drawn using a hashed line.

This is readily addressed by embodiments of a BCM 101 as shown and explained in connection with FIGS. 3*a*-3*c*, 4*a*-4*b*, and 5 and corresponding embodiments.

Figure 2:
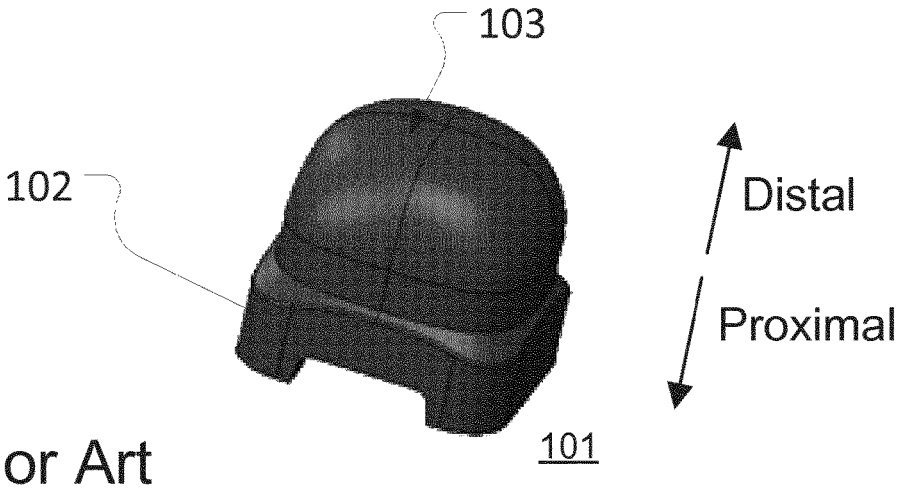
Prior Art FIG. 2
FIG. 2 schematically illustrates a perspective view of one traditional BCM.

FIG. 2 schematically illustrates a perspective view of a traditional BCM. Shown is a traditional BCM 101 comprising a housing 102 with an abutment part 103.

As indicated in FIG. 2 and as already explained, a distal end and an opposite proximal end, as shown by the two opposite arrows, are defined in reference to the BCM 101 where the sides of the BCM are located rotationally about the distal and proximal directions.

The distal end is the end further/furthest away from the voice communication device that the BCM is mounted on or attached to while the proximal end is labelled so since this is the end being closest towards the voice communication device.

The distal abutment part 103 is for abutment against and/or contact typically with tissue of the ear a user and this part is, during use, normally pressed or secured against a wall or part of e.g. an ear of the user and registers the vibration caused by the user speaking and propagating through the user's tissue and/or bone structures. The proximal part of the housing 102 is generally for connecting/interfacing with the rest of a voice communication device or circuit (see e.g. 100 in FIG. 1) and is typically embedded therein or mounted or connected thereto.

FIGS. 3*a*-3*c* schematically illustrate perspective views of three different embodiments of a BCM according to the present invention.

Shown in FIGS. 3*a*-3*c* are embodiments of a bone conduction microphone device 101 adapted to register speech signals from a user where the bone conduction microphone device 101 comprises a housing 102 having an abutment or contact part 103 that has a central axis (not shown; see e.g. 105 in FIG. 4*b*) that is generally parallel to a distal and proximal direction (the distal and proximal directions are the same just with opposite directions) as indicated by the two opposite arrows.

The abutment or contact part 103 is adapted to, during use, abut against and be in vibratory contact with tissue of at least a part of the head (e.g. an inner ear canal as shown as 200 in FIG. 1) or the neck of the user e.g. as explained already in connection with FIG. 1.

The abutment or contact part 103 is further adapted to receive, during use, vibrations (representing a speech signal) propagating through at least a part of the user's tissue and/or bone structure of the head or neck of the user when the user is speaking.

Additionally, the housing 102 further comprises at least one sealing element 110 that substantially or at least partly encircles the abutment or contact part 103 about the central axis 105.

During use, the housing 102 and/or the sealing element 110 will normally be 'squeezed' or deformed somewhat. The sealing element 110 may alternatively also be made of a relatively hard material, which will displace tissue when in place or other materials, as explained later e.g. in connection with FIG. 5.

In the exemplary embodiments of FIGS. 3*a*-3*c*, the at least one sealing element 110 fully encircles the abutment or contact part 103 about the central axis 105. This is preferred, but some sealing or shielding effect (although not quite as much) may be obtained even if the at least one sealing element 110 does not encircle the abutment or contact part 103 fully, e.g. only 99%, 90%, or another value. The less the abutment or contact part 103 is encircled, the less the sealing or shielding effect will generally be and for small values it may be very small or even having no practical effect.

The sealing element 110 will effectively shield the BCM whereby the BCM will not register unwanted vibrations and/or noise or at least register unwanted vibrations and/or noise to a lesser extent.

More particularly, the sealing element 110 will effectively shield the sides of the BCM that otherwise potentially could be exposed to surrounding air if not fully embedded in the tissue of the user.

This may particularly be the case when the BCM is located on a more exposed location of the user's head e.g. like the nose, the neck, on the top of the head, the chin, behind the ear, in the ear (but outside the ear canal) etc.

In some embodiments, the sealing element 110 is adapted to form an air-tight seal when the abutment or contact part 103 is in place during use against the tissue of the user, which may further improve the sealing effect of the sealing element 110.

In some embodiments, e.g. like the ones shown in FIGS. 3*a*-3*c*, the sealing element 110 comprises, in use, at least one closed volume of air. This may further enhance the dampening effect of the sealing element 110.

In some embodiments, the sealing element 110 may e.g. be made of a flexible and/or resilient material, e.g. like silicone or other types of soft rubber or thermoplastics. In this way, the sealing element 110 may form itself according to the actual shape of the tissue of the user, e.g. deform somewhat against the tissue, when in place providing an efficient sealing effect.

Alternatively, the sealing element 110 may be made from a relative hard material, e.g. of materials commonly used to make housings for such devices. This is e.g. shown in FIG. 5. In this way, the sealing element 110 will be comprised by a material, e.g. a hard acrylic polymer, having a hardness sufficient to displace tissue of the user, which may further increase the sealing effect. The material may also be different, e.g. as explained in connection with FIG. 5.

In such embodiments, the material of the sealing element 110 may have a Shore D hardness larger than 40 such as larger than 60, or even more preferably larger than 80. The material may also have another hardness and e.g. be relative softer as explained in connection with FIG. 5.

All the shown embodiments of FIG. 3*a*-3*c* comprise one sealing element 110. However, it is to be understood that other embodiments could comprise two or more sealing elements 110.

The different BCM embodiments of FIGS. 3*a*-3*c* correspond to the BCM shown in FIG. 2 with the addition of one (or more) sealing elements.

Shown in FIG. 3*a* is one embodiment of a BCM 101 comprising a base part or housing 102 and an abutment part 103 corresponding to the ones shown in FIG. 2.

In addition, the BCM 101 comprises a sealing element 110 as described above and elsewhere where the sealing element 110, in this particular and corresponding embodiments, extends outwardly and away from the housing 102 of the BCM. This facilitates a reliable sealing when abutting against skin of the user or a housing of a voice communication device comprising the BCM, especially if the at least one of the at least one sealing element is made of a flexible and/or resilient material.

Figure 6:
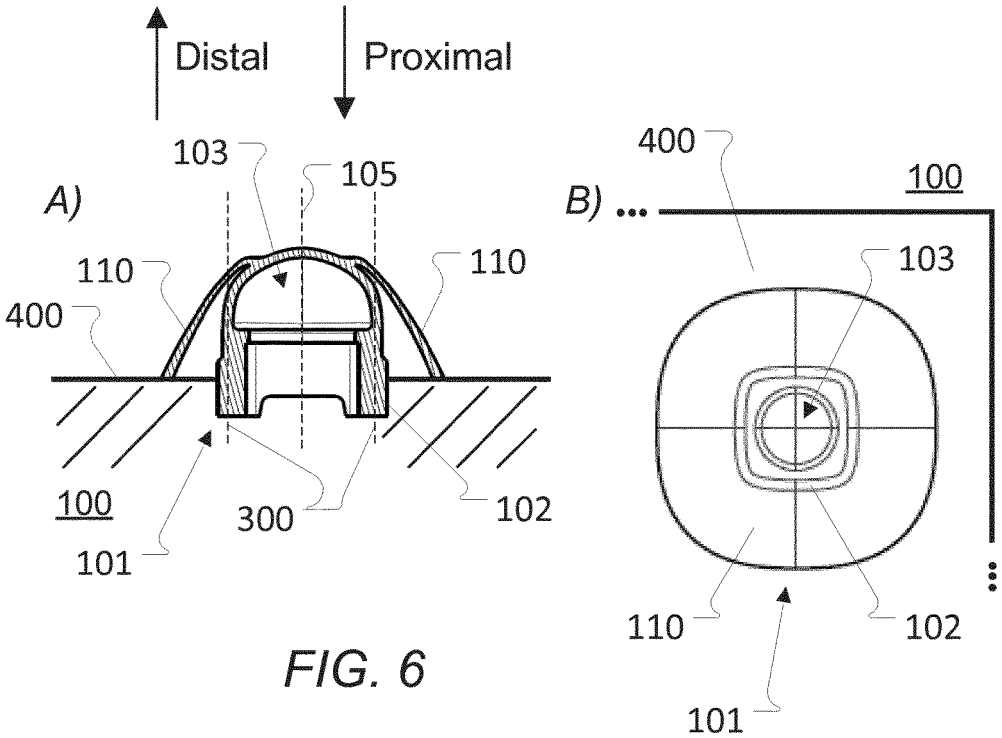
FIGS. 6*a* and 6*b* schematically illustrate a voice communication device comprising an embodiment of bone conduction microphone device.
Figure 7:
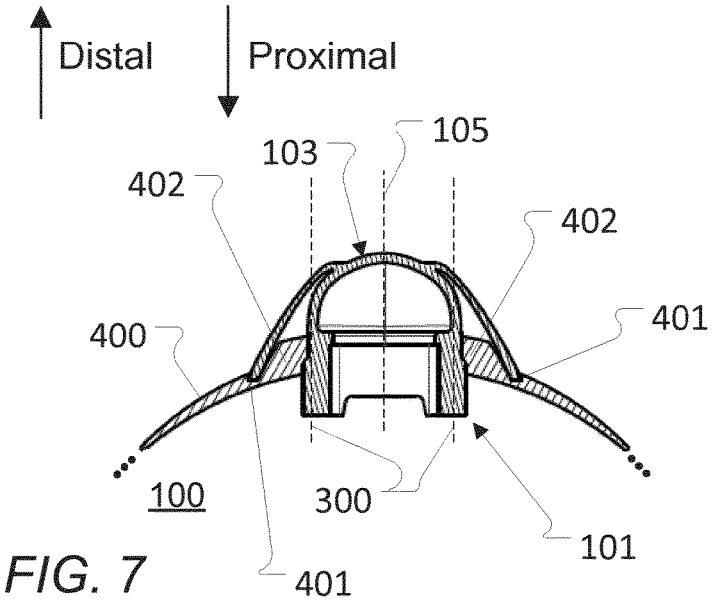
FIG. 7 schematically illustrates another voice communication device comprising an embodiment of bone conduction microphone device.

More specifically, the sealing element 110 generally has a funnel shape, cone shape, or similar extending outwards in the distal direction. It is to be understood that in other embodiments, the sealing element 110 can have a different shape, e.g. a shape having a non-linear profile or cross-section. In other alternatives, the sealing element 110 may extend outwardly and away from the housing 102 of the BCM in the proximal direction, e.g. as shown in FIGS. 3*b*, 6 and 7.

This provides very efficient sealing against unwanted sound and/or noise and thereby efficient suppression of environmental noise in the obtained BCM signal allowing the user's speech to be conveyed with even higher fidelity and intelligibility. In particularly, for locations of the user's head that are exposed.

In certain embodiments, and as shown in FIG. 3*a*, a distal rim 112 of the funnel is substantially level with a most distal part of the abutment or contact part 103, i.e. the distal rim is (more or less) level with the top of the abutment or contact part.

Shown in FIG. 3*b* is another embodiment of a BCM 101 comprising a base part or housing 102 and an abutment part 103 corresponding to the ones shown in FIG. 2.

In addition, the BCM 101 comprises a sealing element 110 as described above and elsewhere where the sealing element 110 in the shown and corresponding embodiments has a different shape and comprises a first funnel (cone or the like) shape extending outwards in the distal direction and a second funnel shape (being connected to the first funnel shape) extending outwards in the proximal direction. This gives the sealing element 110 sort of a (3D) wave or ripple form.

Alternatively, the sealing element comprises a first funnel shape extending outwards in the proximal direction and a second funnel shape (connected to the first funnel shape) extending outwards in the distal direction, which basically just inverts or 'turns' the wave or ripple upside down.

Again, this provides very efficient sealing against unwanted sound and/or noise.

In certain embodiments, and as shown, a distal rim 112 of the first and/or second funnel shape is/are substantially level with a most distal part of the abutment or contact part 103, i.e. the distal rim 112 is more or less level with the top of the abutment or contact part.

Shown in FIG. 3*c* is yet another embodiment of a BCM 101 comprising a base part or housing 102 and an abutment part 103 corresponding to the ones shown in FIG. 2.

In addition, the BCM 101 comprises a sealing element 110 as described above and elsewhere where the sealing element 110 in the shown and corresponding embodiments has yet another shape where it comprises a funnel (cone or the like) shape extending outwards in the proximal direction In all the three shown embodiments, the sealing element 110 defines, in use, at least one closed volume of air.

This and corresponding embodiments also provides very efficient sealing against unwanted sound and/or noise.

Figure 3:
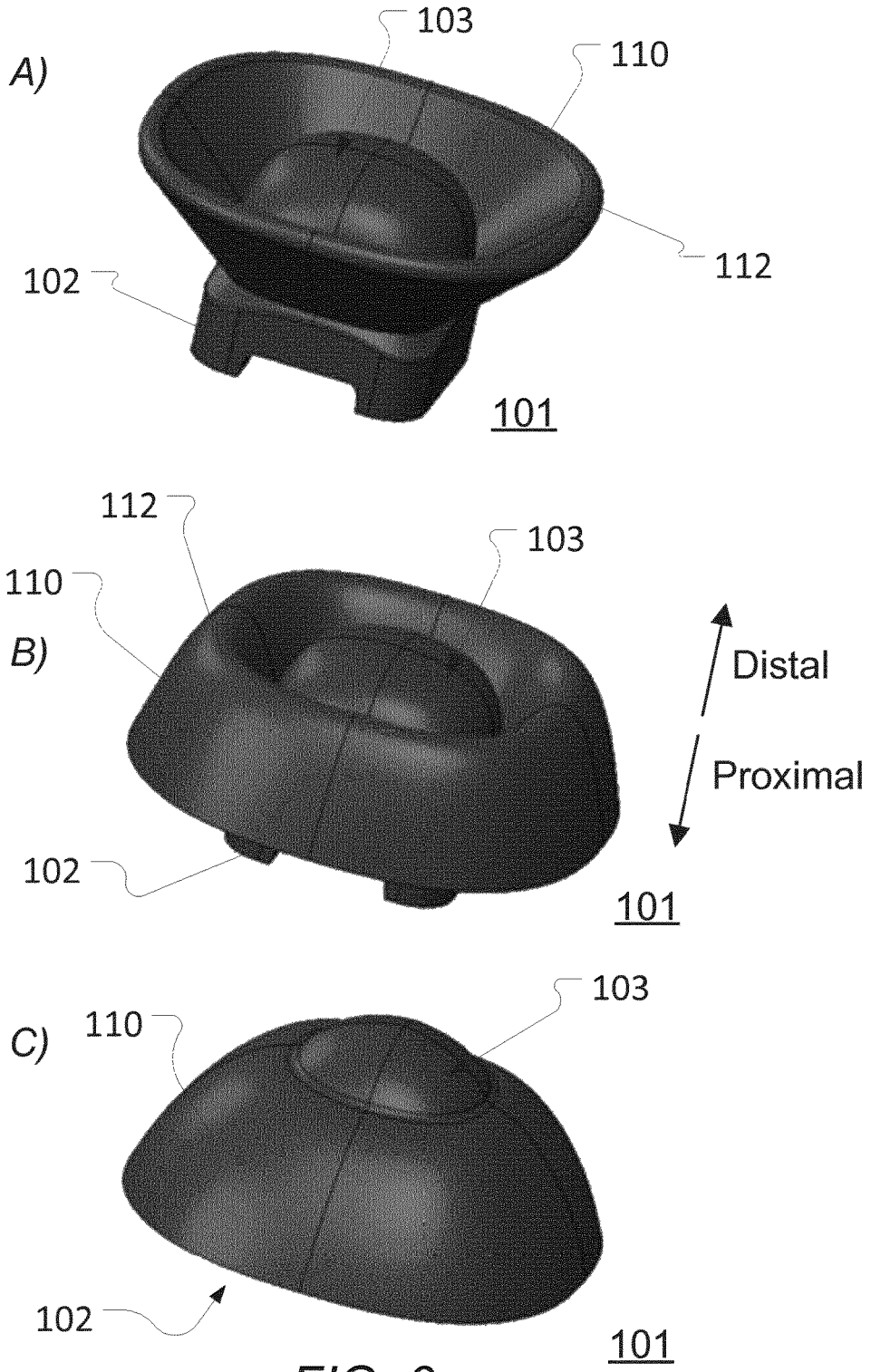
FIGS. 3*a*-3*c* schematically illustrate perspective views of three different embodiments of a BCM according to the present invention.

The various shown embodiments of FIG. 3 and corresponding ones will be more advantageously for certain specific locations on the head or the neck of the user of the BCM and/or also for certain specific layouts of the ear and/or the ear-canal of the specific user.

As one example, a BCM for being inserted into the ear generally side-ways/perpendicular to the distal/proximal directions may perhaps be folded or skewed somewhat. In such cases, the BCM of FIG. 3*c* will be less prone to this than e.g. the BCM of FIG. 3*a*.

The BCM of FIG. 3*b* will—when in place during use—have two volumes in the sealing element that unwanted sound and noise has to propagate through while the BCMs of FIGS. 3*a* and 3*c* only has one.

As mentioned, in some embodiments, one or more distal rims of the funnel(s) and/or a distal part of the one or more sealing elements is/are substantially level with a most distal part of the abutment or contact part. In alternative embodiments, the distal rim of the funnel and/or a distal part of the one or more sealing elements is/are above the most distal part of the abutment or contact part. This may be advantageous especially if the sealing element is flexible and/or resilient. In other alternative embodiments, the distal rim of the funnel and/or a distal part of the one or more sealing elements is/are below the most distal part of the abutment or contact part. This may be advantageous especially if the sealing element is made of a relatively hard(er) material e.g. a hardness sufficient to displace tissue of the user.

Other designs, shapes, etc. may also be contemplated e.g. as described in connection with FIG. 5 and as embodied within the subject matter as defined in the following claims.

The housing 102 of the BCM also defines an exterior radially about a central axis as is shown in and as explained further in connection with FIGS. 4*a*-4*b* and 5-7.

FIGS. 4*a*-4*b* schematically illustrate a top view and a cross-section (along line A-A of FIG. 4*a*) of the BCMs of FIGS. 2 and 3*a*-3*c*.

Shown in FIG. 4*a* is a top view of the BCMs of FIG. 2. From left to right in the figure, the leftmost BCM is the one of FIG. 2 while continuing the BCMs of FIGS. 3*a*, 3*b* and 3*c* are shown, respectively.

Schematically illustrated in FIG. 4*a* is also a central line A-A line where FIG. 4*b* illustrates cross sections of the BCMs of FIG. 4*a* along this line.

Further indicated in FIG. 4*b* is an exterior 300 radially about the central axis 105 for each BCM as defined by the housing 102 of the BCM.

Correspondingly, the housing 102 of the respective BCM defines a radial interior which is to be regarded as being outside the exterior 300.

In the second leftmost BCM, an air-tight seal is formed (formed when the abutment or contact part is in place, during use, against tissue of the user) at least partly in the exterior 300, i.e. both in and outside the exterior or equally put both in the exterior and in the interior as defined above.

In the second rightmost BCM, an air-tight seal is likewise formed at least partly in the exterior 300, i.e. both in and outside the exterior 300.

In the rightmost BCM, an air-tight seal is likewise formed fully in the exterior 300.

FIGS. 4*a* and 4*b* reveals further details and shows the BCMs 101 with their respective base part or housing 102, abutment or contact part 103, sealing element 110, and in the case of FIG. 4*b* their central axis 105 in a distal and the opposite proximal directions also indicated.

Figure 4:
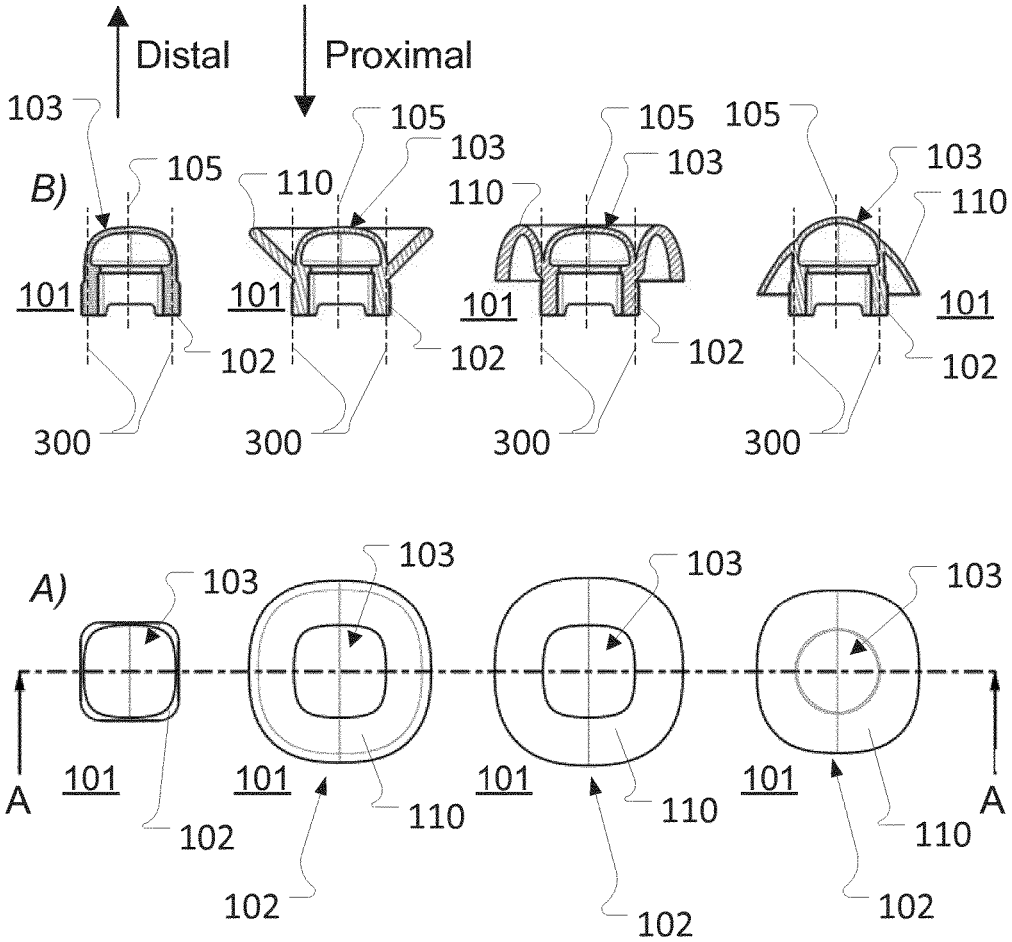
FIGS. 4*a*-4*b* schematically illustrate a top view and a cross-section (along line A-A of FIG. 4*a*) of the BCMs of FIGS. 2 and 3*a*-3*c;*

Even if all the exemplary embodiments of a sealing element 110 shown in FIG. 4 are open, they may also be closed. For embodiments with a plurality of sealing elements 110, one/some could be open while another/others could be closed.

Figure 5:
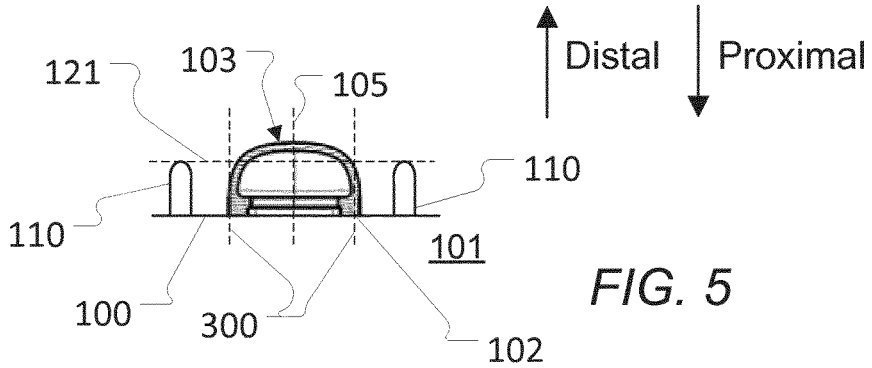
FIG. 5 schematically illustrates a cross-section of a BCM according to another embodiment.

FIG. 5 schematically illustrates a cross-section of a BCM according to another embodiment.

Shown is a BCM 101 having a central axis 105 and comprising an abutment part 103 being attached to a voice communication device 100, all corresponding to the ones explained earlier and elsewhere. In addition, the BCM 101 comprises at least one sealing element 110 as described above where the sealing element 110 where the at least one sealing element 110 substantially or at least partly encircles the abutment part 103 about the central axis 105. Preferably, the at least one sealing element 110 fully encircles the abutment part 103 for best effect.

In this particular embodiment, at least one of the sealing elements 110 is made from a relative hard material, e.g. a hard acrylic polymer or other, having a hardness sufficient to displace tissue of the user, which may further increase the sealing effect.

In such embodiments, the material of the sealing element 110 may have a Shore D hardness as already mentioned.

This will also provide an efficient sealing effect.

Alternatively, at least one of the sealing elements is solid and has a Shore A hardness of 80 or less or a shore D hardness of 60 or less.

Even though the material of one (or more) of the sealing elements are relatively softer is will still displace tissue of the user (due to being solid thereby compressing less) and thus still provide an efficient sealing effect.

In some embodiments, at least one of the at least one sealing element is made of or comprises a core of a foam or foam-like material.

Such foam or foam-like material may e.g. be or comprise polyurethane foam, foams based on natural latex, extruded polystyrene foam, polystyrene foam, phenolic foam, and/or many other types of manufactured foams.

In some embodiments, the at least one sealing element is closed and hollow and encircles the central axis, i.e. having a shape substantially like a torus or similar about the central axis. Some further embodiments could comprise a plurality of tori of different sizes.

Preferably, and as shown, the most distant point of the sealing element 110 (as indicated by a hashed horizontal line 121) is lower than the most distal point of the abutment part 103. Preferably, most distant point of the sealing element is lower than what the abutment part 103 (when soft) will be deformed or squeezed to. In this way, the relatively hard distal surface of the sealing element 110 will be pressed into the tissue of the user (more than the abutment part 103), which will form an effective seal during use.

Further indicated in FIG. 5 is an exterior 300 radially about the central axis 105 of the BCM 101 as defined by the housing 102 of the BCM as explained earlier. In the shown—and corresponding—embodiments, an air-tight seal is formed when the abutment or contact part is in place, during use, against tissue of the user fully in the exterior 300.

FIGS. 6*a* and 6*b* schematically illustrate a voice communication device comprising an embodiment of bone conduction microphone device.

Shown in FIG. 6*a* is a voice communication device 100 comprising an embodiment of bone conduction microphone device 101. The BCM 101 is shown secured in or to a surface of a housing 400 of the voice communication device 100.

In this particular and corresponding embodiments, the BCM 101 comprises a sealing element 110 as described above and elsewhere where the sealing element 110 extends outwardly and away from the housing 102 of the BCM in the proximal direction.

As explained, an air-tight seal is formed by the sealing element 110 and surface of a housing 400 of the voice communication device 100 when the abutment or contact part 103 is in place, during use, against tissue of the user. I.e. the tissue presses the at least one sealing element against the housing 400 of the voice communication device 100 thus forming the air-tight seal.

This facilitates a reliable sealing when abutting against skin of the user or a housing of a voice communication device comprising the BCM, especially if the sealing element 110 is made of a flexible and/or resilient material.

It is noted, that it is not necessary, that the proximal rim of the sealing element 110 touches (although it can do so) the surface of the housing 400. As long as the proximal rim it brought into sufficient contact with the surface of the housing 400 when the abutment or contact part 103 is in place, during use, against tissue of the user. Additionally, in embodiments where the proximal rim of the sealing element 110 do touch the surface of the housing 400 the proximal rim does not need to be secured or fixed to the housing 400. By having a gap or not being secured or fixed to the housing may actually promote easy fitting against tissue of the user as the sealing element 110 then will be more flexible during fitting while still reliably forming an air-tight seal. This goes for all suitable embodiments—not only the one shown in FIGS. 6*a* and 6*b*—where the sealing element 110 extends outwardly and away from the housing 102 of the BCM in the proximal direction.

Further indicated is an exterior 300 radially about the central axis 105 as generally defined by the housing 102 of the BCM 101. Correspondingly, the housing 102 of the respective BCM defines a radial interior which is to be regarded as being outside the exterior 300.

In shown embodiment, the air-tight seal is formed at least partly (and mainly) in the exterior 300.

Shown in FIG. 6*b* is a top-view of the voice communication device 100 and BCM 101 of FIG. 6*a*.

For illustrative purposes the BCM 101 is shown to be located in a corner of the voice communication device 100 but very rarely, if ever, will that be an actual case.

This embodiment of a BCM corresponds somewhat to the rightmost BCM of FIG. 4*b* but with the difference that the sealing element 110 is secured further up (in the distal direction) to the abutment or contact part 103.

FIG. 7 schematically illustrates another voice communication device comprising an embodiment of bone conduction microphone device.

The BCM 101 corresponds, as an example, to the BCM of FIGS. 6*a* and 6*b*. In this figure, the BCM 101 is shown secured in or to a surface of a different housing 400 of a voice communication device 100, where the housing 400 (at least at this location) is curved.

The housing 400 has been adapted to accommodate the sealing element 110 of the BCM 101 in various ways.

The housing 400 comprises a groove 401 or similar that more or less matches the proximal rim of the sealing element 110. This holds (at least to a larger extent) the sealing element 110 in place even when the abutment or contact part 103 is in place, during use, against tissue of the user, which stabilises a formed air-tight seal.

The housing 400 also comprises an elevation or the like 402 around the base part or housing 102 of the BCM 101 where the elevation or the like 402 comprises an abutment surface for supporting at least a proximal part of the sealing element 110 (supporting the surface of the proximal part being closest to the base part or housing 102 of the BCM 101). The abutment surface of the housing 400 will in this way be located under (and providing support to) the proximal part of the sealing element 110 when the BCM 101 is secured to or mounted in the housing 400. This facilitates holding (at least to a larger extent) the sealing element 110 in place even when the abutment or contact part 103 is in place, during use, against tissue of the user, which stabilises a formed air-tight seal.

The abutment surface of the elevation 402 advantageously ends (in the proximal direction) in the groove or similar 401.

The elevation or the like 402 and the groove or the like 401 function particularly well together but it is to be understood that in some embodiments a housing 400 may comprise only one of them or none at all.

The elevation or the like 402 and/or the groove or the like 401 may also be present in differently shaped housings 400 than shown, e.g. a more planar one as shown in FIGS. 6*a* and 6*b* or any other suitably shaped housing.

As mentioned previously, the proximal rim of the sealing element 110 need to be secured to the housing 400. By not being secured to the housing 400, better and/or more comfortable fitting of the BCM 101 to skin of a user is facilitated.

Some preferred embodiments have been shown in the foregoing, but it should be stressed that the invention is not limited to these, but may be embodied in other ways within the subject matter defined in the following claims.

It is to be understood that the precise shape of the base part or housing 102 and the abutment part 103 for all embodiments may vary according to different designs.

In some embodiments, at least one of the at least one sealing element extends outwardly and away from the housing (of the BCM). This facilitates a reliable sealing when abutting against skin of the user or a housing of a voice communication device comprising the BCM, especially if the at least one of the at least one sealing element is made of a flexible and/or resilient material.

In some embodiments, the at least one of the at least one sealing element extends outwardly and away from the housing (of the BCM) in the distal direction. In alternative embodiments, the at least one of the at least one sealing element extends outwardly and away from the housing (of the BCM) in the proximal direction.

In some embodiments, the at least one sealing element is adapted to encircle at least a distal end of the abutment or contact part.

In some embodiments, the at least one sealing element is adapted to encircle at least a most distal end of the abutment or contact part.

In some embodiments, the air-tight seal is formed by the at least one sealing element and the tissue of the user when the abutment or contact part is in place, during use, against the tissue of the user. In alternative embodiments, the air-tight seal is formed by the at least one sealing element and a housing of a voice communication device comprising the bone conduction microphone device when the abutment or contact part is in place, during use, against the tissue of the user. I.e. the tissue presses the at least one sealing element against the housing of the voice communication device thus forming the air-tight seal.

In some embodiments, the housing (of the BCM) defines an exterior radially about the central axis and wherein the air-tight seal is formed in or at least partly in/inside the exterior. 'Partly' signifying that the air-tight seal is formed both in and outside the exterior (outside the exterior being the radial interior as correspondingly defined by the housing of the BCM).

In some embodiments, at least one sealing element defines at least one closed volume of air radially about the central axis (i.e. between the central axis and the sides of the BCM and encircling the central axis). I.e. this closed volume is not formed but rather present all the time regardless of whether the BCM is in place against tissue or not. In some embodiments, the at least one sealing element is closed and hollow and encircles the central axis, i.e. having a shape substantially like a torus or similar about the central axis. In some further embodiments, the at least one sealing element comprises a plurality of tori of different sizes.

In some embodiments, the housing (of the BCM) defines an exterior radially about the central axis and wherein at least one of the at least one closed volume of air is located in or at least partly in the exterior. Partly (again) signifying that the closed volume of air is located both in and outside the exterior (outside the exterior being the radial interior as correspondingly defined by the housing of the BCM).

In the claims enumerating several features, some or all of these features may be embodied by one and the same element, component or item. The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, elements, steps or components but does not preclude the presence or addition of one or more other features, elements, steps, components or groups thereof.

The invention claimed is:

1. A bone conduction microphone device adapted to register speech signals from a user, the bone conduction microphone device comprising a housing comprising an abutment or contact part, the abutment or contact part having a central axis being substantially parallel to a predetermined distal direction and a predetermined proximal direction, the distal direction generally being a direction away from a voice communication device that the bone conduction microphone device is mounted or attached to and the proximal direction generally being a direction towards the voice communication device, being configured to, during use, abut against and be in vibratory contact with tissue of at least a part of a head or neck of the user, and being further configured to receive, during use, vibrations representing a speech signal and propagating through at least a part of the user's tissue or bone structures in the head or neck of the user when the user is speaking, wherein the housing further comprises or is connected to at least one sealing element the at least one sealing element substantially or at least partly encircling the abutment or contact part about the central axis.

2. The bone conduction microphone device according to claim 1, wherein at least one of the at least one sealing element fully encircles the abutment or contact part about the central axis.

3. The bone conduction microphone device according to claim 1, wherein at least one of the at least one sealing element extends outwardly and away from the housing.

4. The bone conduction microphone device according to claim 3, wherein the at least one of the at least one sealing element extends outwardly and away from the housing in the distal direction.

5. The bone conduction microphone device according to claim 3, wherein at least one of the at least one sealing element extends outwardly and away from the housing in the proximal direction.

6. The bone conduction microphone device according to claim 1, wherein the at least one sealing element is configured to encircle at least a distal end of the abutment or contact part.

7. The bone conduction microphone device according to claim 6, wherein the at least one sealing element is configured to encircle at least a most distal end of the abutment or contact part.

8. The bone conduction microphone device according to claim 1, wherein the abutment or contact part is configured to abut against and be in vibratory contact, during use, with tissue of at least a part of an inner ear canal of the user, of at least an outer part of an ear of the user, located behind the ear of the user, of a neck of the user, of a cheek of the user, of a top of the head of the user, of a nose of the user, or on a throat of the user.

9. The bone conduction microphone device according to claim 1, wherein the at least one sealing element is configured to form an air-tight seal when the abutment or contact part is in place, during use, against the tissue of the user.

10. The bone conduction microphone device according to claim 9, wherein the air-tight seal is formed by the at least one sealing element and the tissue of the user when the abutment or contact part is in place, during use, against the tissue of the user.

11. The bone conduction microphone device according to claim 9, wherein the air-tight seal is formed by the at least one sealing element and a housing of a voice communication device comprising the bone conduction microphone device when the abutment or contact part is in place, during use, against the tissue of the user.

12. The bone conduction microphone device according to claim 9, wherein the housing defines an exterior radially about the central axis and wherein the air-tight seal is formed in or at least partly in the exterior.

13. The bone conduction microphone device according to claim 1, wherein the at least one sealing element defines at least one closed volume of air radially about the central axis.

14. The bone conduction microphone device according to claim 13, wherein the housing defines an exterior radially about the central axis and wherein at least one of the at least one closed volume of air is located in or at least partly in the exterior.

15. The bone conduction microphone device according to claim 1, wherein at least one of the at least one sealing element is made of a flexible or resilient material.

16. The bone conduction microphone device according to claim 1, wherein at least one of the at least one sealing element has a funnel shape extending outwards in the distal direction.

17. The bone conduction microphone device according to claim 16, wherein a distal rim of the funnel is substantially level with a most distal part of the abutment or contact part.

18. The bone conduction microphone device according to claim 1, wherein at least one of the at least one sealing element comprises a first funnel shape extending outwards in the distal direction and a second funnel shape, being connected to the first funnel shape, extending outwards in the proximal direction, or comprises a first funnel shape extending outwards in the proximal direction and a second funnel shape, being connected to the first funnel shape, extending outwards in the distal direction.

19. The bone conduction microphone device according to claim 18, a distal rim of the first or second funnel shape being substantially level with a most distal part of the abutment or contact part.

20. The bone conduction microphone device according to claim 1, wherein at least one of the at least one sealing element has funnel shape extending outwards in the proximal direction.

21. The bone conduction microphone device according to claim 1, wherein at least one of the at least one sealing element have a hardness sufficient to displace tissue of the user.

22. The bone conduction microphone device according to claim 1, wherein at least one of the at least one sealing element is configured to displace tissue of the user more than what the abutment or contact part will displace.

23. The bone conduction microphone device according to claim 1, wherein at least one of the at least one sealing element has a Shore D hardness larger than 40, or larger than 60, or larger than 80.

24. The bone conduction microphone device according to claim 1, wherein at least one of the at least one sealing element is solid and has a Shore A hardness of 80 or less or a shore D hardness of 60 or less.

25. The bone conduction microphone device according to claim 1, wherein the bone conduction microphone device comprises two or more sealing elements.

26. The bone conduction microphone device according to claim 1, wherein the at least one sealing element is closed and hollow and encircles the central axis.

27. The bone conduction microphone device according to claim 1, wherein at least one of the at least one sealing element is made of or comprises a core of a foam or foam-like material.

28. The bone conduction microphone device according to claim 1, wherein at least one of the at least one sealing element extends outwardly and away from the housing in the proximal direction and wherein the sealing element comprises a proximal part and rim configured to fit securely into a groove of a housing of a voice communication device when the voice communication device comprises the bone conduction microphone device, or be supported by an elevation of a housing of a voice communication device when the voice communication device comprises the bone conduction microphone device, the elevation comprising an abutment surface configured to support a surface of the proximal part being closest to the housing of the bone conduction microphone device.

29. A voice communication device comprising a bone conduction microphone device according to claim 1.

30. The voice communication device according to claim 29, wherein the voice communication device is any one of a headset unit, an earphone, an in-ear voice communication device, a hearing aid, a throat microphone, a skull microphone, or a voice communication device with at least one microphone but without any speaker.

31. The voice communication device according to claim 29, wherein the voice communication device comprises a housing comprising a groove configured to receive and hold a proximal rim of the sealing element of the bone conduction microphone device, or an elevation comprising an abutment surface configured to support a surface of the proximal part of the sealing element of the bone conduction microphone device, the surface being closest to the housing of the bone conduction microphone device.

* * * * *